US005901376A

United States Patent [19]

Deirmendjian et al.

[11] Patent Number: 5,901,376

[45] Date of Patent: May 11, 1999

[54] SURGICAL GOWN

[76] Inventors: Gary Kara Deirmendjian, North Parramatta; Eugene Sherry, Gordon, both of Australia

[21] Appl. No.: 08/941,980

[22] Filed: Oct. 1, 1997

[30] Foreign Application Priority Data

Oct. 2, 1996 [AU] Australia ..... P02708

[51] Int. Cl.[6] ..... A41D 13/00; A41D 27/00

[52] U.S. Cl. ..... 2/114; 2/52; 2/51

[58] Field of Search ..... 24/115 G, 712.3, 24/712.1, 714.6; 2/46, 49.2, 48, 49.1, 49.3, 49.4, 49.5, 50, 51, 52, 69, 69.5, 75, 80, 83, 174, 114, 105, 106, 115, 113, 141.1, 244, 912, 913, 914, 920, 88, 96, 102, 119, 111, 128

[56] References Cited

U.S. PATENT DOCUMENTS 2,902,734 9/1959 Walters ..... 2/52
3,843,971 10/1974 Delanty et al. ..... 2/114
4,290,148 9/1981 Roberts ..... 2/51
4,395,782 8/1983 Reynolds ..... 2/114
4,457,024 7/1984 Wichman ..... 2/51

*Primary Examiner*—Jeanette Chapman
*Attorney, Agent, or Firm*—Oppenheimer Wolff & Donnelly LLP

[57] ABSTRACT

A gown of the type having an opening to enable enrobement and at least one gown closure means for substantially closing the opening of the gown, comprising a flap adapted, in use, to substantially cover the gown closure means. A flap closure means operable to hold the flap in a position where it substantially covers the gown closure means, a shielded closure device removably attached to the flap and/or the flap closure means to enable operation of the flap closure means. A method of enrobement using the gown and a shielded adhesive closing device are also disclosed.

15 Claims, 5 Drawing Sheets

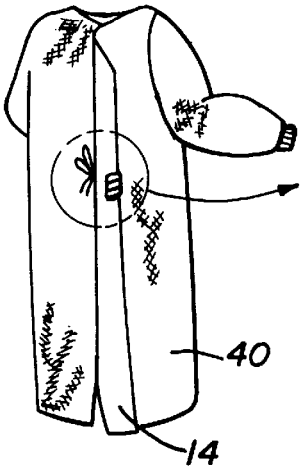
FIG. 7
FIG. 7a
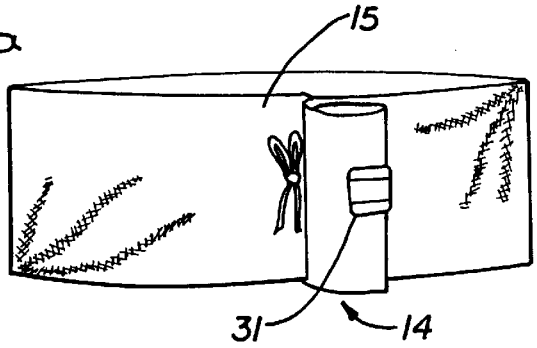
FIG. 7b
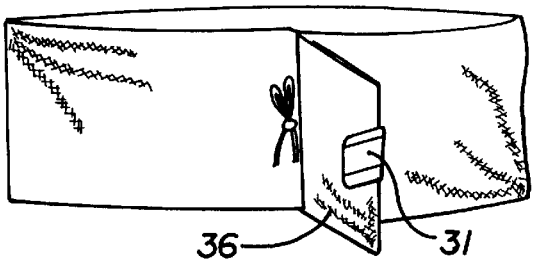
FIG. 7c
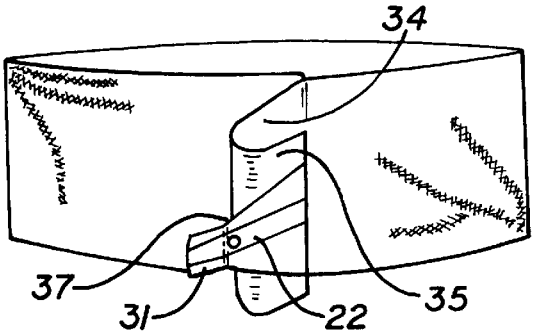
FIG 7d
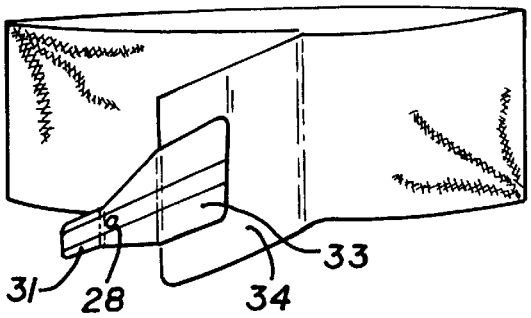
FIG. 7e
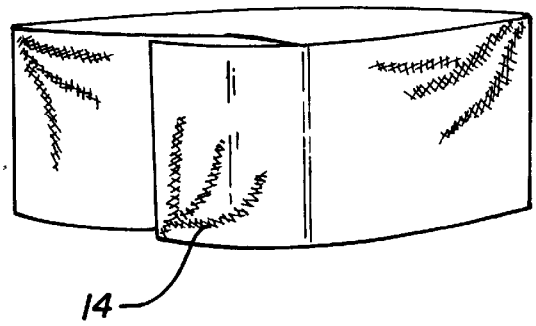

SURGICAL GOWN

TECHNICAL FIELD

The present invention relates to a disposable gown design and corresponding robing technique. Although the invention will be described in relation to a sterile surgical gown manufactured from a paper based fabric as typically utilised in the current disposable gowns, the invention is not limited to using such materials or for use in such applications.

BACKGROUND ART

Operating gown design must consider the protection of the surgeon from fluid penetration by providing an impervious barrier for the torso and forearm. The gown must be easy and quick to put on for both the wearer and gown assistant. It must be more convenient, cheaper and ecologically sound than the non-disposable cloth gowns. The highest reasonable standard of sterility of the operating field must be achieved to avoid surgical patient contamination and post operative wound infections.

Current disposable gown manufacturers have all adopted the same overall design which is similar to that of the traditional cloth gown. The only apparent innovations are in the manufacturing techniques adopted and material types used.

FIGS. 1*a* to c illustrate the front, back and top views respectively of the current gown design which is used extensively. It consists of neck ties 1 (hook and loop type fasteners are sometimes used here instead of ties), mid-back ties 2, sterile ties 3 and 4, and a sterile paper tie link 5, 6 and 7 are the non-sterile and sterile flaps respectively. The sterile flap 7 is folded back and held there by the connection of the sterile tie 3, paper link 5 and left side sterile tie 4, in the front of the gown. FIGS. 2*a* and b illustrate the applied gown from the front and the back respectively. The closure of the unfolded sterile flap 7 is shown in FIG. 2*b*. The sterile flap 7 covers the non-sterile flap 6 and non-sterile tie connections 2. The neck tie closure 1 is exposed. FIG. 2*a* also shows the sterile tie connection between ties 3 and 4.

The sterile zone 8 can be defined as a three-dimensional arc wedge as shown in FIGS. 3*a* and b. The base and the top of the wedge extends from the waist to the nipple line with the tip at the centre of the surgeon. The sides of the wedge radiate at an angle 13 of approximately 40° to the back plane of the surgeon.

Prior to putting on the gown, the surgeon is first scrubbed and then proceeds to unfold the gown. This is done by holding the gown at the neck and letting it unfold towards the ground without actually reaching it. The surgeon then proceeds to pass both arms through the respective arms of the gown alone. The gloves are put on next by the surgeon. The gown assistant steps behind the surgeon while they are applying the gloves or right afterwards and begins to apply the ties at the rear of the gown. The assistant first applies the neck tie 1 and then proceeds to tie the mid-back tie 2 (see FIG. 1). Both are non-sterile ties. Once this is complete the gown assistant 10 then moves to the front right side of the surgeon 9 as shown in FIGS. 4*a* and b. The surgeon 9 then undoes the connection of the sterile tie 4 from the paper tie link 5 while maintaining its connection with the sterile tie 3. The tie link 5 is held in the right hand of the surgeon 9 who then reaches it out to the assistant 10 to hold. At this point, either the surgeon 9 turns counter clockwise on the spot 11 with arms raised high while the assistant 10 stands still as in FIG. 4*a*, or the surgeon 9 stands still with the arms raised high while the assistant 10 walks clockwise 12 around the back of the surgeon. In either case, the assistant will end up on the front left side of the surgeon while still holding the paper tie link 5. The surgeon then pulls the sterile tie 3 off the link 5 and proceeds to tie it to the sterile tie 4 and thus makes the final connection as shown in FIG. 2*a*. Gown assistants are usually unscrubbed (i.e. unclean). Sometimes the final tie is assisted by a scrubbed (i.e. clean) assistant.

The current gown design presents a number of problems requiring attention. The surgical gowns are commonly put on in the operating theatre or at least the final sterile tie is completed in the theatre. Discipline in the operating room is important to minimise accidental contamination of the gown and by the gown. One way of decreasing contamination is by reducing air currents and the amount of movement in the operating theatre, thereby decreasing the opportunity for contamination.

The sterile tie 3 may break during the final twirl if the paper link 5 is pulled too tightly or is yanked by the assistant 10 (see FIG. 4). It is more common for the sterile tie 3 to become disconnected with the paper link 5. In both instances, the damaged gown is discarded and a new gown must be put on.

During the application of the sterile flap 7 using the sterile tie 3, air currents are generated during the turning process illustrated in FIG. 4. This is true in either case. The case where the assistant turns around the surgeon while holding the paper link 5 is more severe since the sterile flap 7 acts as a sail, causing air to move, and the general range of movement is much larger.

When the surgeon 9 turns on the spot for the final sterile tie 3 application as shown in FIG. 4*a*, the unclean back of the surgeon may come into contact with sterile draping in the theatre.

Confusion often occurs as to which direction one must turn during the final step of gown application.

Throughout the application of the current gown it becomes necessary for the surgeon's hands to approach the extremes of the sterile zone a number of times (see FIG. 3). When commencing the sterile flap application, the sterile paper tie link 5 (see FIG. 4) is handed to the gown assistant. The surgeon's right hand is at the right extreme of the sterile zone. When the turn is complete, the surgeon's left hand is at the left extreme of the sterile zone. When the turn is complete, the surgeon's left hand is at the left extreme of the zone as it receives and disconnects the sterile tie 3 from the link 5 and proceeds to tie it to 4 with both hands. Both arms are raised during the turn thus approaching the upper ceiling of the sterile zone. The right hand of the surgeon comes within about 10 cm of the unclean hand of the gown assistant as the assistant receives the sterile tie link 5. The sterile zone of the surgeon is invaded by the body of the assistant during the application of the sterile flap 7. When the final tie 3 is assisted by a sterile assistant, then the unclean back of the surgeon invades the sterile zone of the sterile assistant during the turn.

When the gown is fully worn, the sterile straps (i.e. 3 and 4 in FIG. 2*a*) on the left side remain exposed. During the operation, these ties may get entangled with the surroundings (i.e. with stands, medical devices, etc.) and cause tearing. A new gown must be used in order to maintain sterility.

SUMMARY OF THE INVENTION

The present invention seeks to overcome or at least ameliorate the above problems of the prior art by providing an improved gown design and method of fitting the gown.

According to one aspect, the present invention provides a gown of the type having an opening to enable enrobement and at least one gown closure means for substantially closing said opening of the gown, a flap adapted, in use, to substantially cover said gown closure means, flap closure means operable to hold said flap in a position where it substantially covers said gown closure means, a shielded closure device removably attached to said flap and/or said flap closure means to enable operation of said flap closure means.

For preference, said opening is at the rear of the gown. Preferably, said gown is provided with a first gown closure means for partially closing said rear opening and a further gown closure means for substantially closing said rear opening of the gown. For further preference, said flap closure means releasably hold said flap in position.

For preference, said shielded closure device is configured to allow removal from said flap and/or said flap closure means without direct contact being made with the flap. Preferably, said flap is folded upon itself, in an non-covering position and unfolded to cover said further closure means when said flap closure means is operable. In a preferred form, said closure device is operable to unfold said flap prior to enablement of said flap closure means.

For preference, said first closure means is located at or adjacent a neck portion of said gown. Preferably, said gown is constructed of material enabling ready disposal, for example, a paper material. In a preferred form, said further closure means is located at or adjacent a waist portion of said gown.

In a second aspect, the present invention provides a method of robing using the gown of the first aspect comprising the following steps:

a) the user applying the gown through said opening;

b) the user or an assistant closing said opening using said gown closure means;

c) an assistant holding said shielded closure device and unfolding said flap to cover said gown closure means;

d) an assistant holding said shielded closure device to cause operation of said flap closure means;

e) removing said shielded closure device from said flap and/or said flap closure means without direct contact being made with the flap.

According to a further aspect, the present invention provides a shielded closure device, for use with the above described gown, comprising a double sided adhesive element having an associated removable backing element attached to one facing side of said adhesive element, a masking element removably attached to the other facing side of the adhesive element and having a number of apertures to allow selected portions of said adhesive element corresponding to the location of said apertures to be adhered to said gown through said apertures.

Preferably, a central section of said adhesive element is exposed by one of said apertures and is affixed to an inner side of said flap which faces the gown when said flap is in said closed position, said central section having means to enable separation from the remainder of said adhesive element.

For preference, said adhesive element has two end sections on each side of said central section, one end section having a region of adhesive exposed by a further one of said apertures, said region of adhesive being affixed to an outer side of said flap.

Preferably, said inner side of said flap ha two parts, one part being adjacent the gown and the other part being adjacent a free edge of said flap, said central section of the adhesive element being affixed to said one part and the other of said two end sections being affixed to said other part of the flap by a further region of adhesive exposed by a further one of said apertures in the masking element.

BRIEF DESCRIPTION OF THE DRAWINGS

A preferred embodiment of the invention will now be described, by way of example only, with reference to the accompanying drawings, in which:

FIG. 7 shows a pictorial view from the left side of the wearer of the adhesive device of FIG. 5 and 6 applied to the flap of a gown and FIGS. 7*a* to 7*e* show an enlarged view of the outlined region of FIG. 7 illustrating the sequence of operations in closing the flap;

DESCRIPTION OF THE PREFERRED EMBODIMENT

Figure 1A:
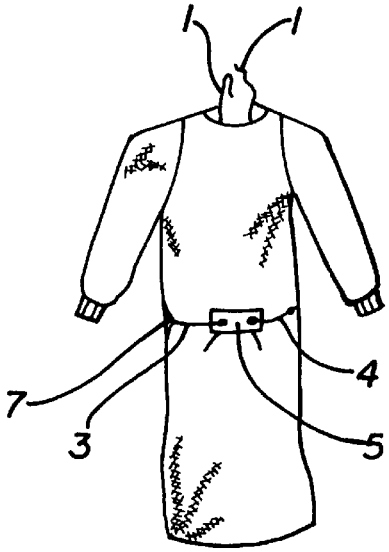
FIG. 1*a* shows a pictorial view of the front of a prior art surgical gown.
Figure 1B:
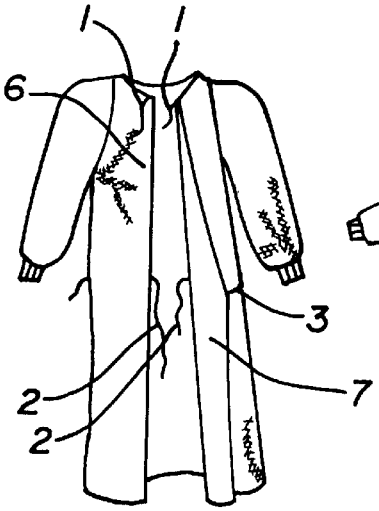
FIG. 1*b* shows a rear pictorial view of the gown of FIG. 1*a;*
Figure 1C:
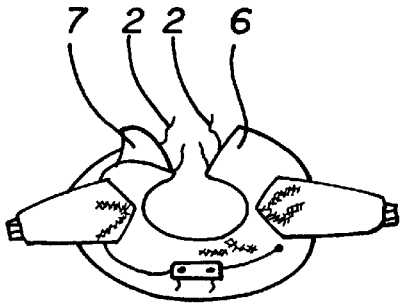
FIG. 1*c* shows a top pictorial view of the gown of FIG. 1*a;*
Figure 2A:
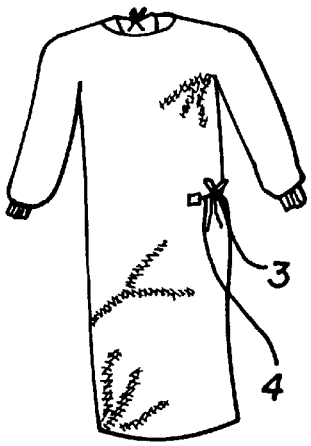
FIG. 2*a* shows a pictorial view of the front of a prior art surgical gown when fitted to the surgeon.
Figure 2B:
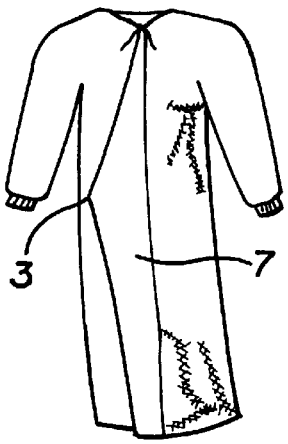
FIG. 2*b* shows a rear pictorial view of the gown of FIG. 2*a;*
Figure 3A:
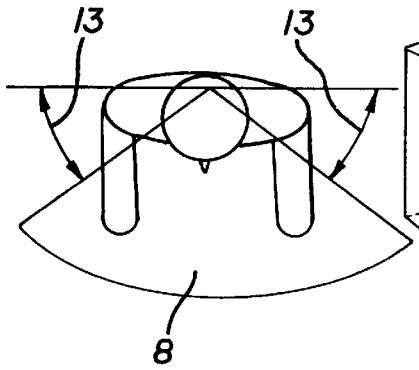
FIG. 3*a* shows a top pictorial view of a surgeon illustrating the sterile zone.
Figure 3B:
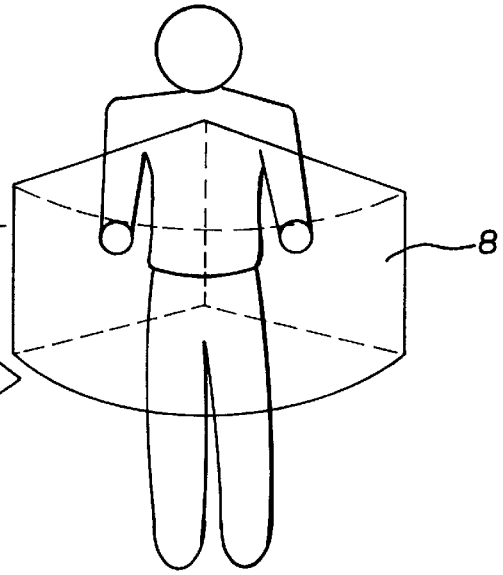
FIG. 3*b* shows a front pictorial view of the surgeon of FIG. 3*a;*
Figure 4A:
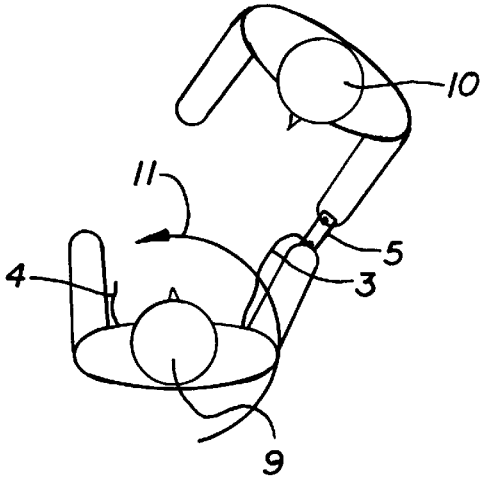
FIGS. 4*a* and 4*b* show a top pictorial view of the prior art method of fitting the gown of FIG. 1*a;*
Figure 4B:
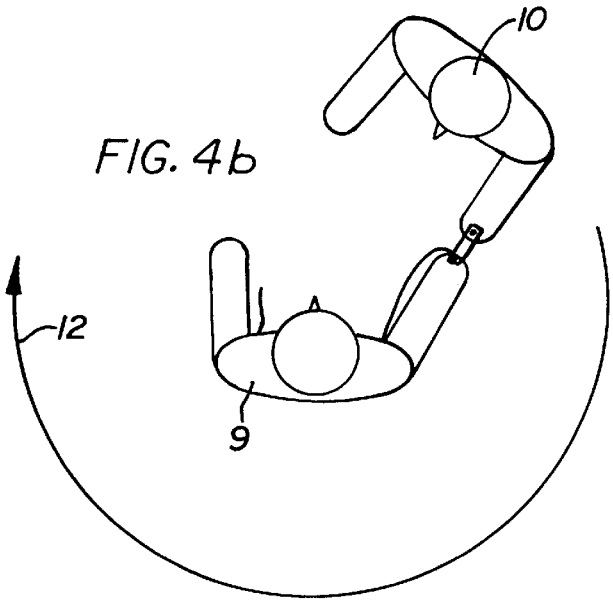
Figure 5:
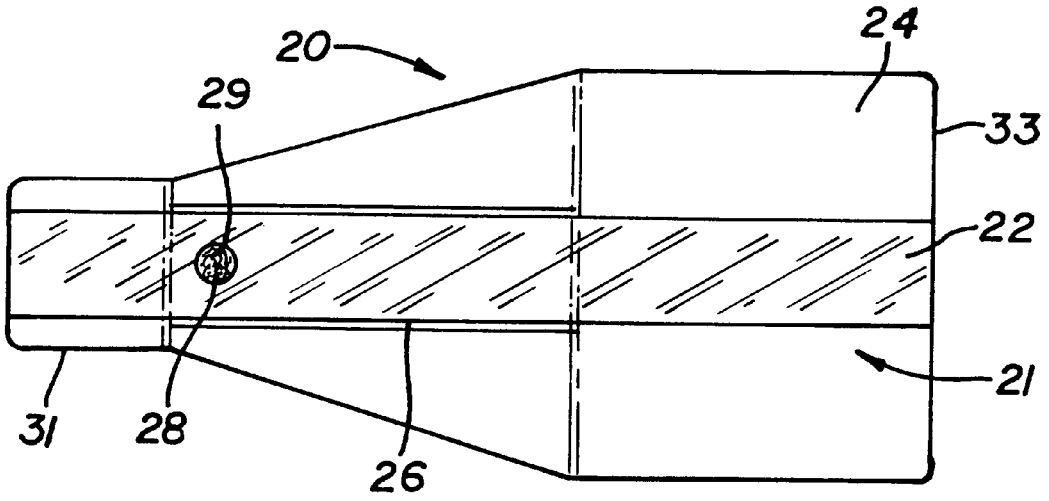
FIG. 5 shows a plan view of the shielded closure device according to a preferred embodiment of the present invention.
Figure 6:
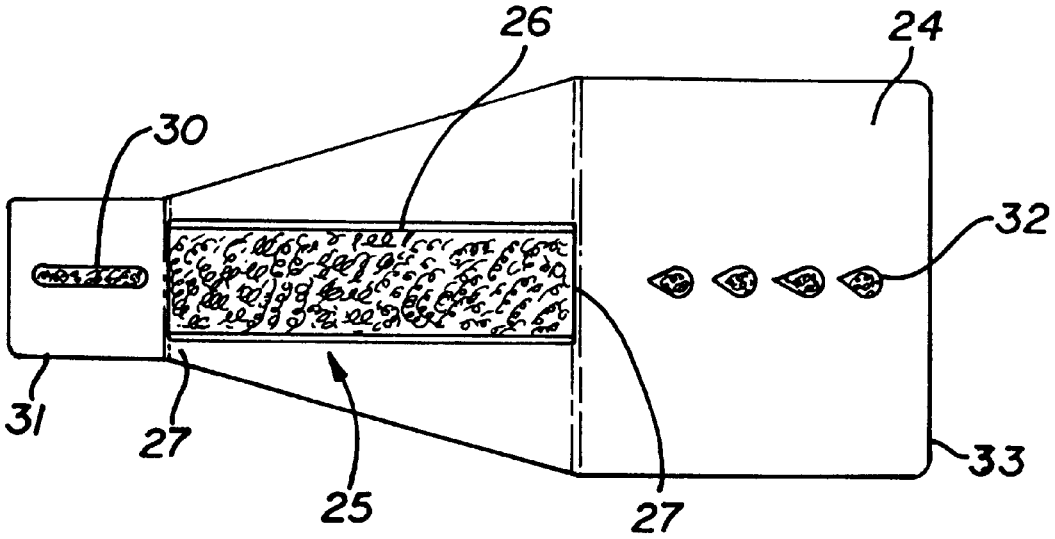
FIG. 6 shows an underside view of the shielded adhesive device of FIG. 5.

Referring to FIG. 5, the shielded adhesive device 20 is shown. The element is shown with one backing sheet removed. Viewed from one side the adhesive device 20 comprises a strip of double-sided adhesive element 21 having a backing sheet 22 applied to one side 23 and an intermediate masking element 24, which masks and reveals selected areas of the other side of the adhesive element 21. As best shown in FIG. 6, the middle section 25 of the adhesive element 21 is exposed by an elongate aperture 26 in the masking element 24. The middle section 25 of strip 21 has perforations 27 at either end to allow separation from the remainder of the adhesive strip 21. The section of the backing sheet 23 corresponding to the middle section 25 has a small cut out 28 to expose a region 29 of the adhesive element 21. Smaller areas of the adhesive element are exposed by a slot 30 in tab 31 and a series of cut outs 32 in large tab 33. These small areas allow weak adhesion or tacking of portions of the adhesive device to the gown in use.

FIGS. 7*a* to 7*e* show the area of FIG. 7 in enlargement and illustrate the sequence of operations in using the adhesive device 20 to close the gown 40 without contacting the sterile areas of the gown.

The gown flap 14 is double folded with the sterile section 34 of the flap 14 being arranged to face inwardly. When folded, the flap 14 can be considered to consist of three sections, an inner sterile section 34, an outer non-sterile section 35 (on the opposite side of the flap to that of the sterile section) and connecting section 36 joining the sterile and non-sterile flap sections to the gown.

Figure 8:
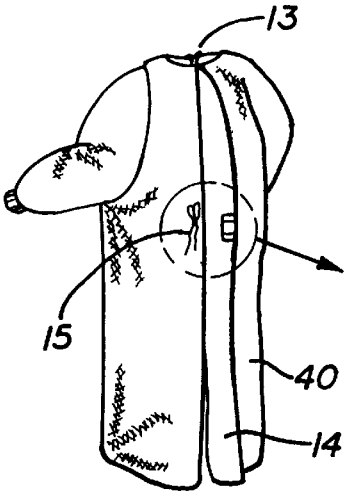
FIGS. 8, 8*a* to 8*c* show similar views to FIGS. 7 to 7*e* but from the right side of the wearer.

The adhesive device 20 is applied to the sections of the gown flap as shown in FIGS. 7 and 8. The exposed central section 25 of adhesive element is attached through aperture 26 to outer non-sterile section 35 while cut outs 32 are used to tack the device to the sterile section 34 of the flap. Tab 31 is affixed to the connecting section 36 of the flap.

Figure 8A:
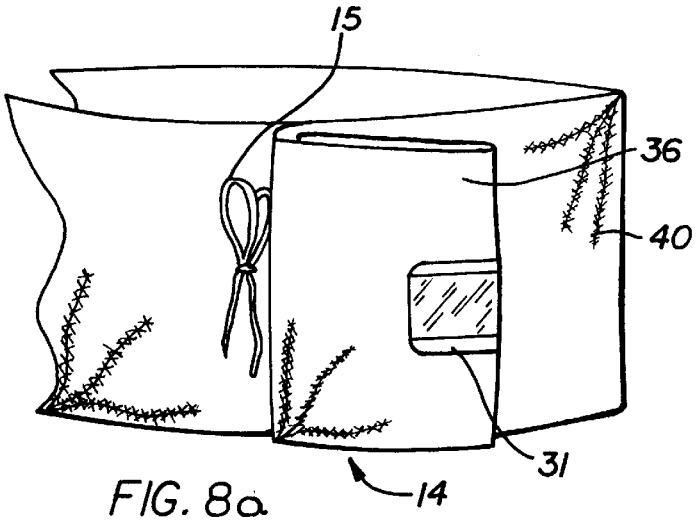
Figure 8B:
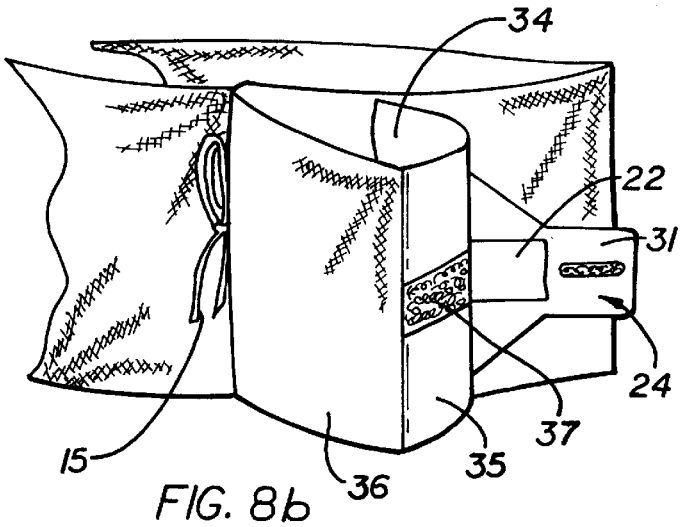
Figure 8C:
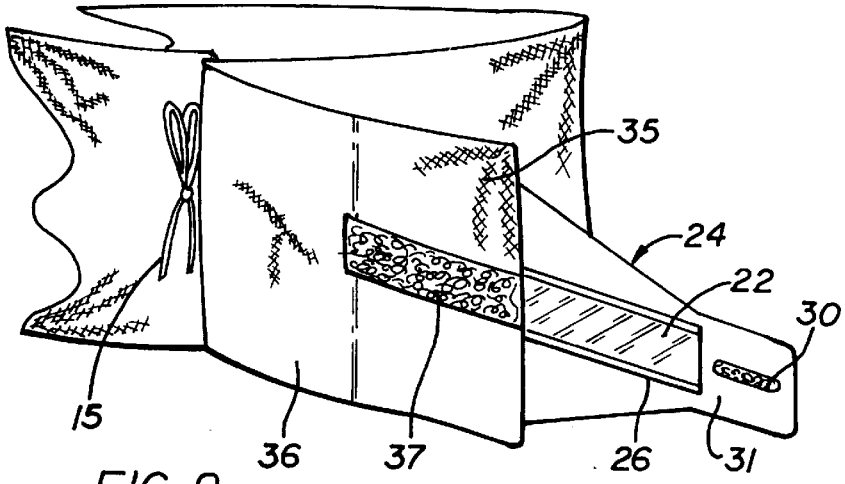
Figure 1A:
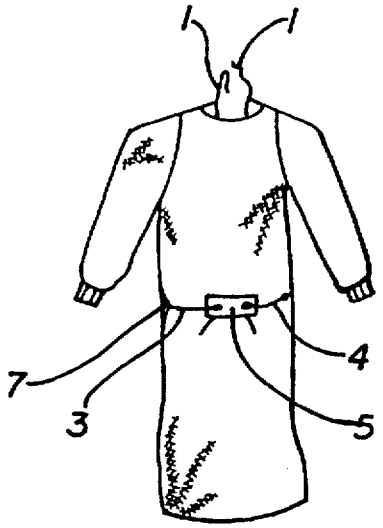
Figure 1B:
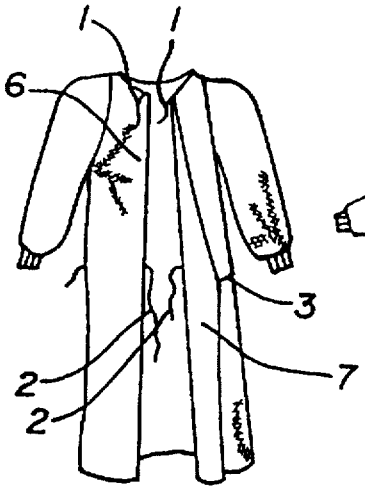
Figure 1C:
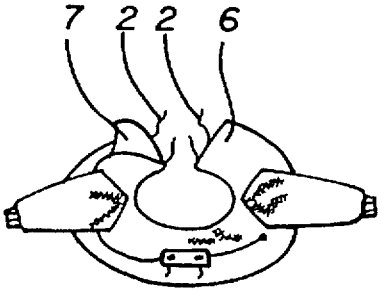
Figure 2A:
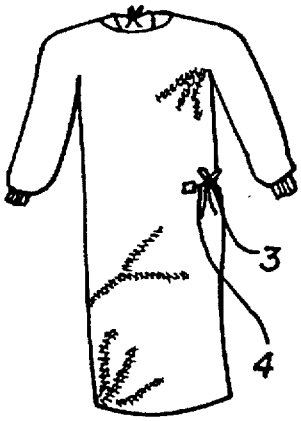
Figure 2B:
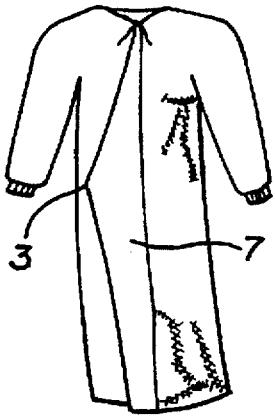
Figure 3A:
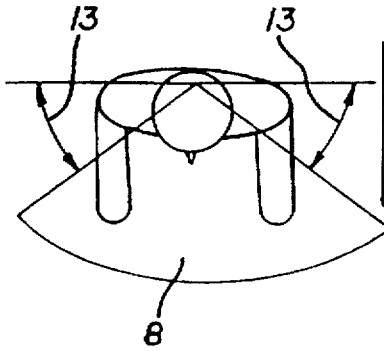
Figure 3B:
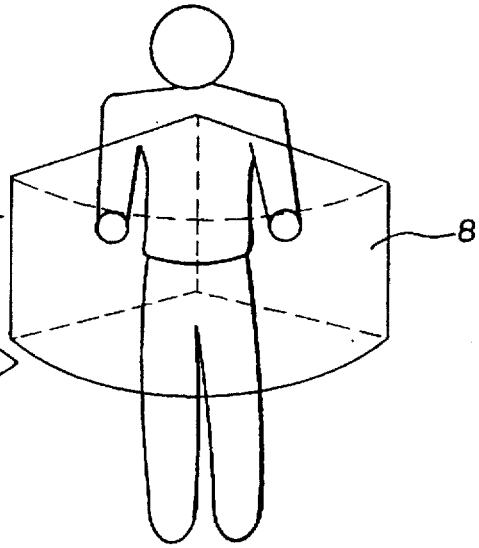
Figure 4A:
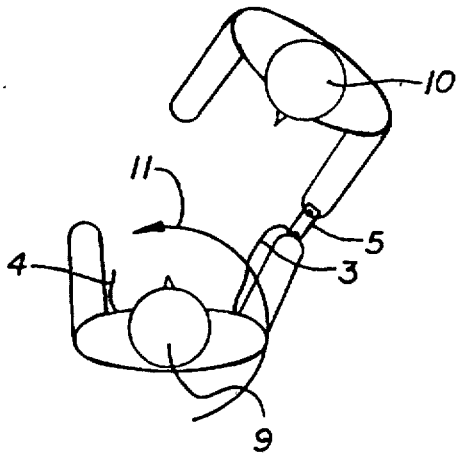
Figure 4B:
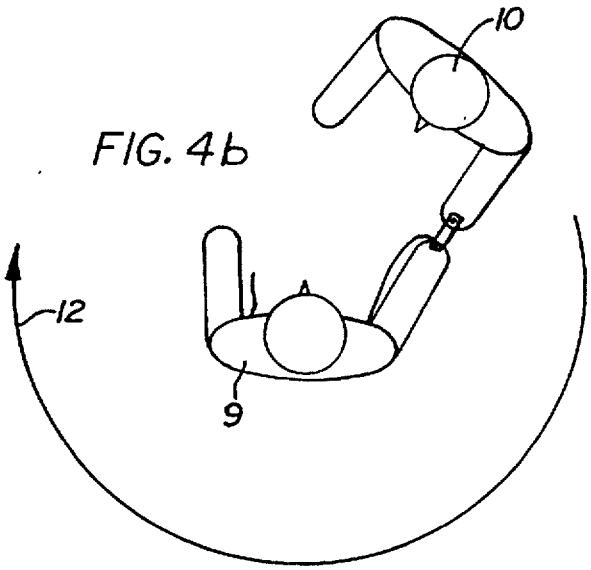
Figure 5:
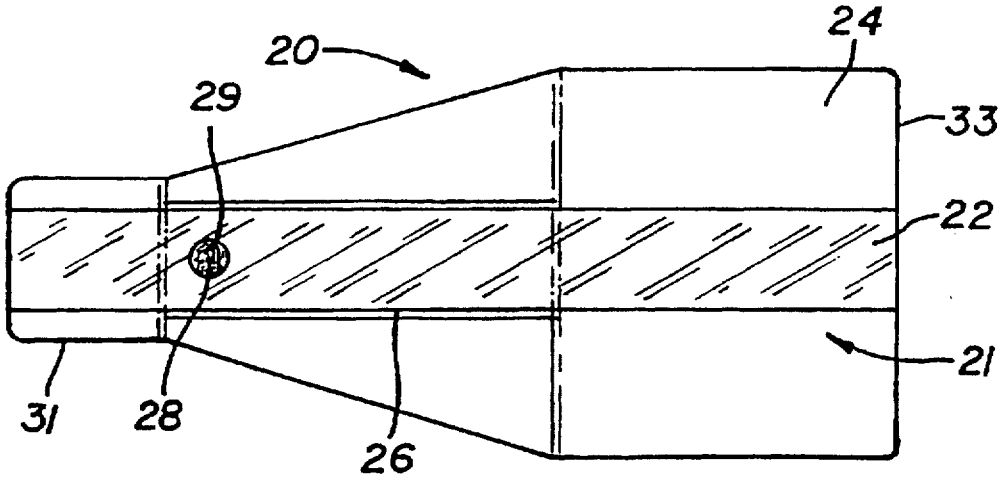
Figure 6:
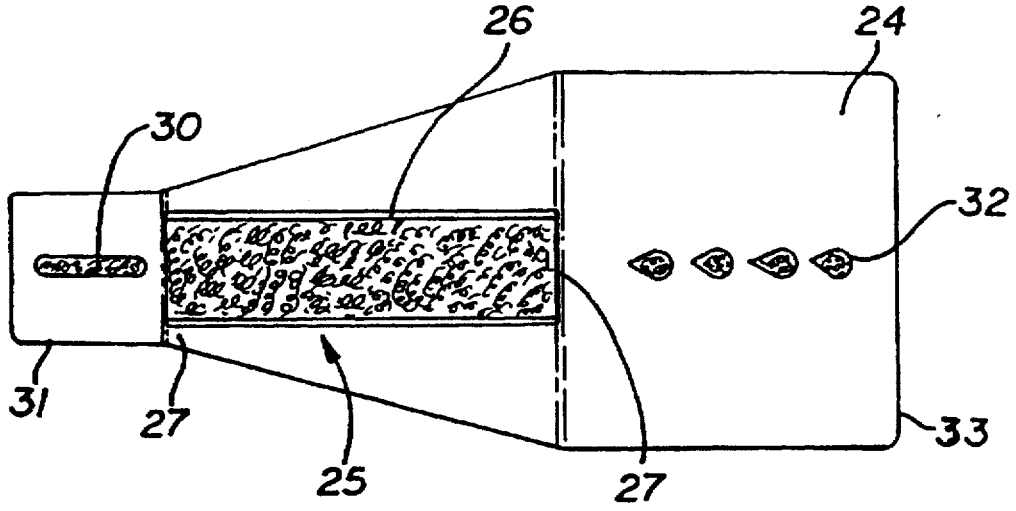
Figure 8:
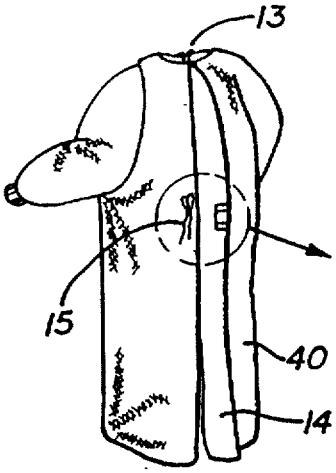
Figure 8A:
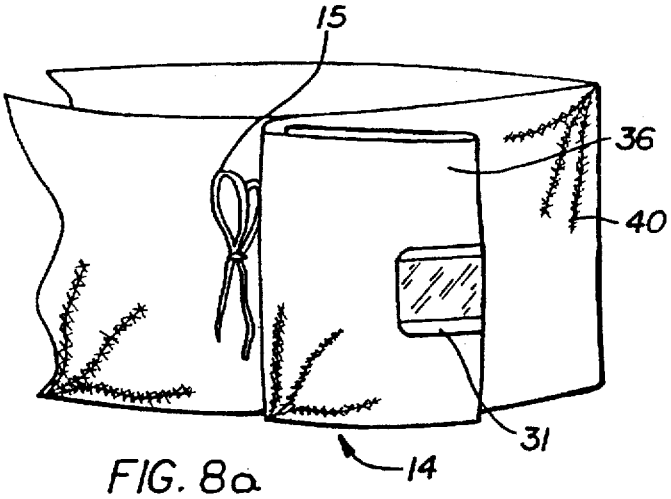
Figure 8B:
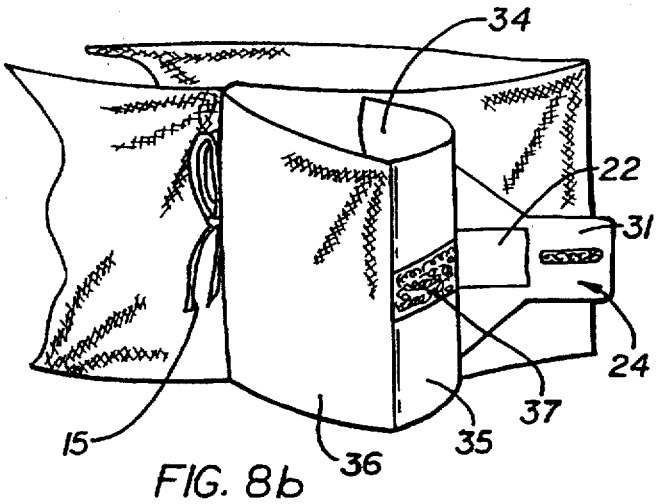
Figure 8C:
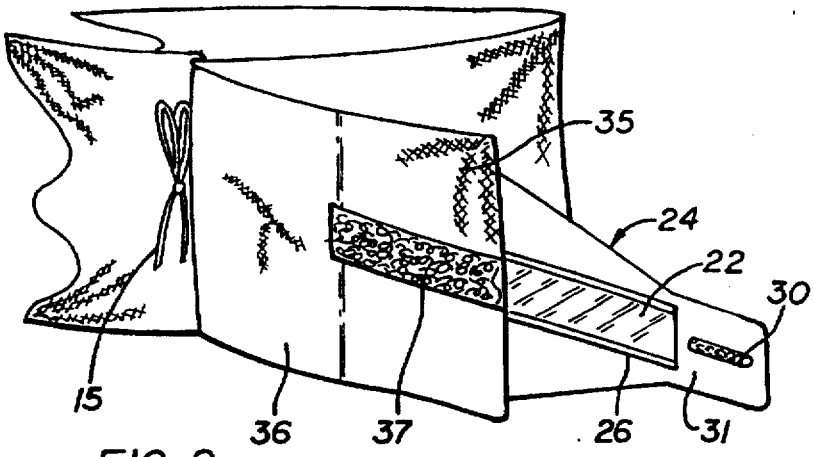
Figure 9A:
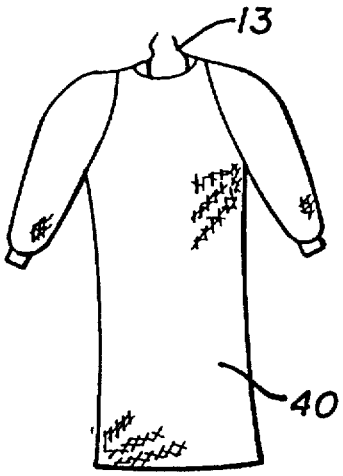
FIGS. 9*a*, 9*b* and 9*c* show front, rear and top views, respectively of the gown according to a preferred embodiment of the present invention in an open configuration.
Figure 9B:
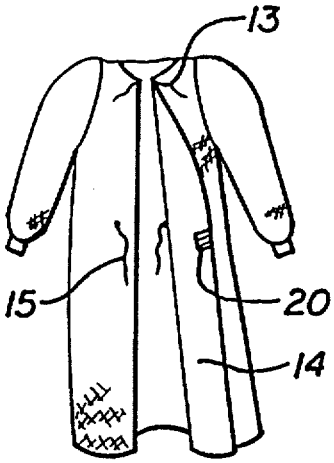
Figure 9C:
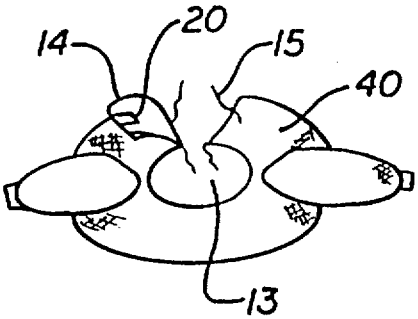
Figure 10A:
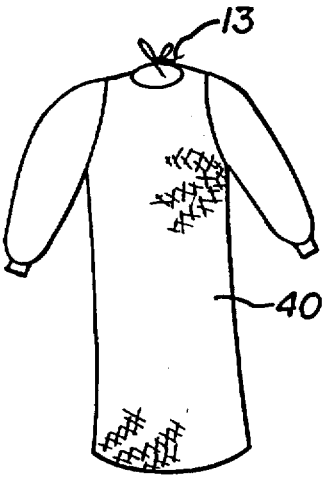
FIGS. 10*a* and 10*b* show front and rear views, respectively of the gown of FIG. 9 with the flap in a closed configuration.
Figure 10B:
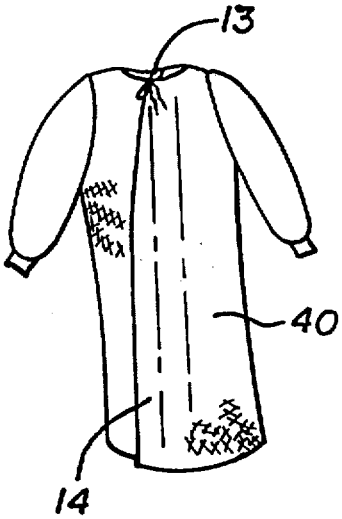

As shown in FIGS. 7*a* and 8*a*, when the flap 14 is double folded only the tab 31 is exposed. The double folded flap 14 is held in position against the gown by means of adhesive region 29. When the flap 14 is to be closed, the tab 31 is lifted from the gown flap connecting section 36 as shown in FIG. 7*b* and the adhesive region 29 pulled away from the gown surface. As the flap is unfolded by pulling on the tab 31, the backing sheet 22 is removed from the other side of the central section 25 of the adhesive element to expose adhesive region 37 as shown in FIGS. 7*c*, 8*b* and 8*c*. The flap 14 is then closed by bringing the exposed adhesive region 37 into contact with the gown as shown in FIG. 7*d*. The adhesive region 37 is pushed into contact in a sterile manner by applying pressure to large tab 33. The remaining adhesive section and backing sheet and intermediate masking element 24 is then removed by breaking the perforations 27 and disengaging the adhesive areas in cut outs 32 through continued pulling on tab 31 to leave the flap closed as shown in FIG. 7*e*. It will be appreciated that this sequence of operations enable the flap to adhesively close without any non-sterile contact with the sterile outer section of the flap 14.

The method of application of the gown can be described as follows. Prior to putting on the gown the surgeon is first scrubbed and then proceeds to unfold the gown. This is done by holding the gown at the neck and letting it unfold towards the ground without actually reaching it. The surgeon then proceeds to pass both arms through the respective arms of the gown alone. The gloves are put on next by the surgeon. The gown assistant steps behind the surgeon while they are applying the gloves. Up to this point the application technique is identical to that of the current gown.

From here the gown assistant steps behind the surgeon and proceeds firstly to apply the neck tie 13. Secondly the mid-back ties 15 are applied. A desired level of tension or gown comfort may be achieved across the stomach region of the surgeon during the application of this tie by providing direct feedback to the assistant. This step may be taken a number of times without any concern of potential loss of sterility as is the case in current gowns (once the sterile tie is released from the paper link it is very difficult to adjust for comfort). Since the ties 15 are located symmetrically at the rear of the gown, when they are pulled a symmetrically comfortable fit may be achieved more readily.

Thirdly, the assistant holds the shielded adhesive device 20 by the tab 31 using their left hand and pulls continuously. The flap 14 and the attached device 20 is folded back on itself as shown in FIGS. 7*a* and 8*a* and held in place by the dot of exposed adhesive 29. The sterile flap 14 then unfolds in a controlled manner when the adhesive dot disengages from the gown body, to reveal the outer side of sterile flap 14. As the tab is continued to be pulled the adhesive region 37 is exposed as shown in FIGS. 7*c*, 8*b* and 8*c*. The flap 14 is then closed by bringing the exposed adhesive region 37 into contact with the gown as shown in FIG. 7*d*. The adhesive region 37 is pushed into contact in a sterile manner by applying pressure to large tab 33 and thus covering all of the ties and non-sterile flap 16. The shielded device 20 is then removed by disengaging adhesive regions 32. This concludes the gown application.

The invention offers a totally new design for surgical gowns that seeks to overcome or at least ameliorate the difficulties and problems presented by the current gown and its robing technique.

The invention offers a simple three-step gown application technique. The gown assistant performs all three steps while at all times remaining behind the surgeon. The need for the assistant to approach and at times invade the surgeon's sterile zone is totally eliminated. The need for any sterile tie transaction between the surgeon and the assistant is also eliminated. The surgeon's hands are contained within the sterile zone and far from the zone extremes as well as far from the assistant, at all times during the gown application. There is no need with this invention for the surgeon to raise his arms (i.e. during the twirl), to approach the right extreme of the zone with their right hand (i.e. handing the sterile paper link 5 to assistant), and to approach the left extreme zone with their left hand (to pick up the sterile tie 3 from assistant and to attach it to sterile tie 4). There are no exposed ties since all the ties are contained underneath the sterile flap 14 once it is applied. This reduces the risk of tie failure due to entanglement and/or material rupture. With this invention there is no requirement for both parties to move about during the full robing process. This helps reduce the introduction of air currents and general movement and thus reduces the risk of contamination in the operating theatre.

It will be appreciated that further embodiments and exemplifications of the invention are possible without departing from the spirit or scope of the invention described.

We claim:

1. A gown of the type having an opening to enable enrobement and at least one gown closure means for substantially closing said opening of the gown, comprising a flap adapted, in use, to substantially cover said gown closure means, flap closure means operable to hold said flap in a position where it substantially covers said gown closure means, a shielded closure device removably attached to said flap and/or said flap closure means to enable operation of said flap closure means.

2. A gown according to claim 1 wherein the gown is provided with a first gown closure means for partially closing said opening and a further gown closure means for substantially closing said opening of the gown.

3. A gown according to claim 1 wherein said flap closure means comprise a double-sided adhesive element adapted to adhere the flap to said gown.

4. A gown according to claim 1 wherein said shielded closure device is configured to allow removal from said flap and/or said flap closure means without direct contact being made with the flap.

5. A gown according to claim 1 wherein said flap is folded upon itself, in a non-covering position and unfolded to cover said further closure means when said flap closure means is operable.

6. A gown according to claim 5 wherein said closure device is operable to unfold said flap prior to operation of said flap closure means.

7. A gown according to claim 2 wherein said first closure means is located at or adjacent a neck portion of said gown, and said further closure means is located at or adjacent a waist portion of said gown.

8. A method of robing using the gown according to claim 1 comprising the following steps:

a) the user applying the gown through said opening;

b) the user or an assistant closing said opening using said gown closure means;

c) an assistant holding said shielded closure device and unfolding said flap to cover said gown closure means;

d) an assistant holding said shielded closure device to cause operation of said flap closure means; and e) removing said shielded closure device from said flap and/or said flap closure means without direct contact being made with the flap.

9. A gown as defined in claim 1 further comprising a shielded closure device, including a double sided adhesive element having an associated removable backing element attached to one facing side of said adhesive element, a masking element removably attached to the other side of the adhesive element having a number of apertures to allow selected portions of said adhesive element corresponding to the location of said apertures to be adhered to said gown through said apertures.

10. A gown including a shielded closure device according to claim 9 wherein a central section of said adhesive element is exposed by one of said apertures and is adapted, in use, to be affixed to a side of said flap which faces the gown when said flap is in said closed position, said central section having means to enable separation from the remainder of said adhesive element.

11. A gown including a shielded closure device according to claim 10 wherein said adhesive element has two end sections on each side of said central section, one end section having a region of adhesive exposed by a further one of said apertures, said region of adhesive being adapted, in use, to be tacked to an outer side of said flap.

12. A gown including a shielded closure device according to claim 11, wherein said inner side of said flap has two parts, one part being adjacent the gown and the other part being adjacent a free edge of said flap, said central section of the adhesive element adapted, in use to be affixed to said one part and the other of said two end sections adapted in use to be tacked to said other part of the flap by a further region of adhesive exposed by a further one of said apertures in the masking element.

13. A gown according to claim 2 wherein said flap closure means comprise a double-sided adhesive element adapted to adhere the flap to said gown.

14. A shielded closure device, for use with a gown having an opening to enable enrobement and at least one gown closure for substantially closing said opening of the gown, said shielded closure device comprising a double sided adhesive element having an associated removable backing element attached to one facing side of said adhesive element, a masking element removably attached to the other side of the adhesive element having a number of apertures to allow selected portions of said adhesive element corresponding to the location of said apertures to be adhered to said gown through said apertures.

15. The gown combination of claim 9 wherein the removable backing element has an aperture at the location of said central section exposing an area of adhesive therethrough for tacking said flap to said gown to hold the flap in a non covering position.

* * * * *

UNITED STATES PATENT AND TRADEMARK OFFICE

CERTIFICATE OF CORRECTION

PATENT : 5,901,376

DATED : May 11, 1999

INVENTOR(S) : Gary Kara Deirmendjian and Eugene Sherry

It is certified that error appears in the above-identified patent and that said Letters Patent is hereby corrected as shown below:

Title page should be deleted to be replaced with the attached title page.

Sheets 1-5, of the drawings should be deleted to be replaced with the sheets of drawings, as shown on the attached pages.

The drawing sheet, consisting of Figs. 9a, 9b, 9c, 10a and 10b, should be added, as shown on the attached page.

Signed and Sealed this

Seventh Day of March, 2000

*Attest:*

*Attesting Officer*

Q. TODD DICKINSON

*Commissioner of Patents and Trademarks*

United States Patent [19]

Deirmendjian et al.

[11] Patent Number: 5,901,376

[45] Date of Patent: May 11, 1999

[54] SURGICAL GOWN

[76] Inventors: Gary Kara Deirmendjian, North Parramatta; Eugene Sherry, Gordon, both of Australia

[21] Appl. No.: 08/941,980

[22] Filed: Oct. 1, 1997

[30] Foreign Application Priority Data

Oct. 2, 1996 [AU] Australia ..... P02708

[51] Int. Cl.[6] ..... A41D 13/00; A41D 27/00

[52] U.S. Cl. ..... 2/114; 2/52; 2/51

[58] Field of Search ..... 24/115 G. 712.3. 24/712.1. 714.6; 2/46. 49.2. 48. 49.1. 49.3. 49.4. 49.5. 50. 51. 52. 69. 69.5. 75. 80. 83. 174. 114. 105. 106. 115. 113. 141.1. 244. 912. 913. 914. 920. 88. 96. 102. 119. 111. 128

[56] References Cited

U.S. PATENT DOCUMENTS

| | | | |
|---|---|---|---|
| 2,902,734 | 9/1959 | Walters | 2/52 |
| 3,843,971 | 10/1974 | Delanty et al. | 2/114 |
| 4,290,148 | 9/1981 | Roberts | 2/51 |
| 4,395,782 | 8/1983 | Reynolds | 2/114 |
| 4,457,024 | 7/1984 | Wichman | 2/51 |

*Primary Examiner*—Jeanette Chapman

*Attorney, Agent, or Firm*—Oppenheimer Wolff & Donnelly LLP

[57] ABSTRACT

A gown of the type having an opening to enable enrobement and at least one gown closure means for substantially closing the opening of the gown, comprising a flap adapted, in use, to substantially cover the gown closure means. A flap closure means operable to hold the flap in a position where it substantially covers the gown closure means, a shielded closure device removably attached to the flap and/or the flap closure means to enable operation of the flap closure means. A method of enrobement using the gown and a shielded adhesive closing device are also disclosed.

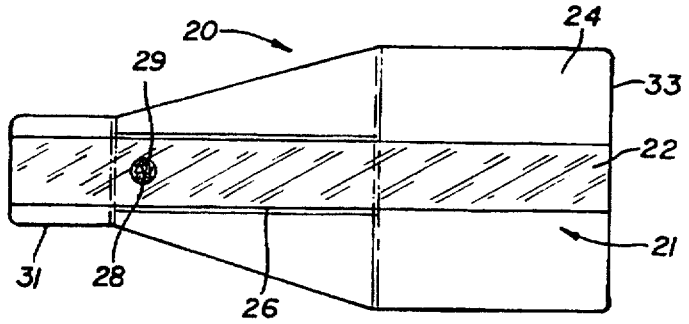

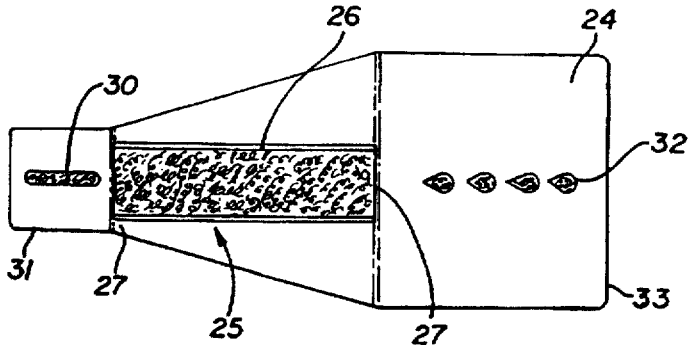

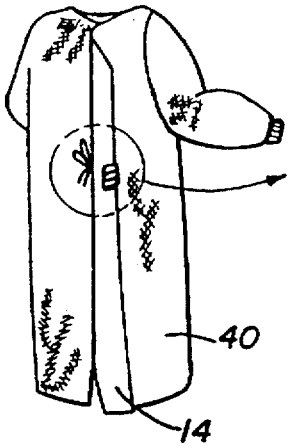
FIG. 7
FIG. 7a
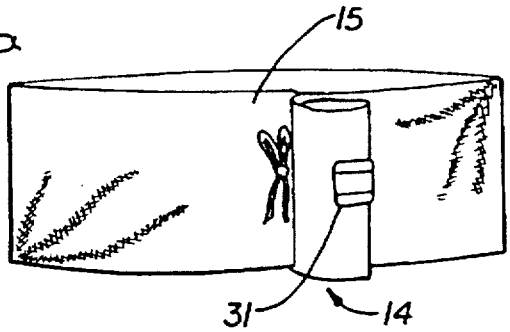
FIG. 7b
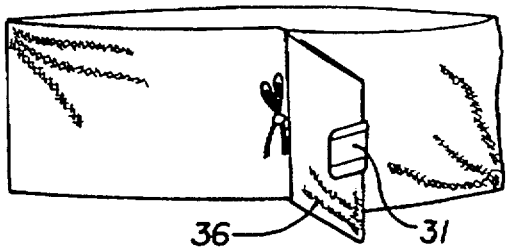
FIG. 7c
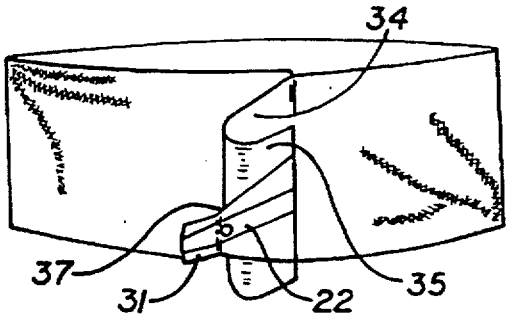
FIG 7d
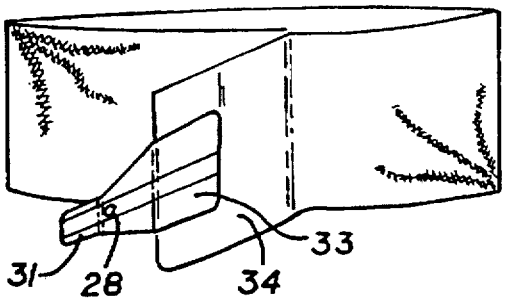
FIG. 7e
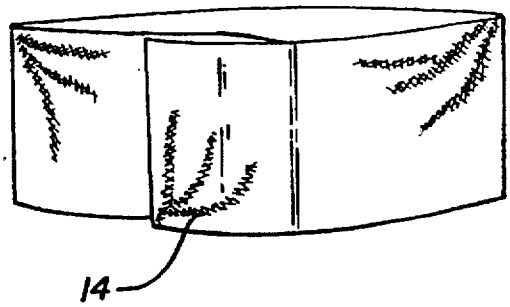

15 Claims, 6 Drawing Sheets